US009663344B2

(12) United States Patent
Makkonen

(10) Patent No.: US 9,663,344 B2
(45) Date of Patent: May 30, 2017

(54) APPARATUS FOR HAZARDOUS-FLUID DELIVERY VEHICLE AND STORAGE TANK

(71) Applicant: Neal Antero Makkonen, Grande Prairie (CA)

(72) Inventor: Neal Antero Makkonen, Grande Prairie (CA)

( * ) Notice: Subject to any disclaimer, the term of this patent is extended or adjusted under 35 U.S.C. 154(b) by 0 days.

(21) Appl. No.: 14/589,296

(22) Filed: Jan. 5, 2015

(65) Prior Publication Data

US 2016/0194099 A1 Jul. 7, 2016

(51) Int. Cl.

| | |
|---|---|
| ***B65B 3/14*** | (2006.01) |
| ***B67D 7/32*** | (2010.01) |
| ***B67D 7/02*** | (2010.01) |

(52) U.S. Cl.

CPC ..... *B67D 7/3218* (2013.01); *B67D 7/02* (2013.01); *B67D 7/3209* (2013.01)

(58) Field of Classification Search

CPC . B65B 3/14; E21B 43/26; F16K 31/02; F16K 31/12; B67D 7/02; B67D 7/3209; B67D 7/3218

USPC ..... 141/1, 311 R

See application file for complete search history.

(56) References Cited

U.S. PATENT DOCUMENTS

| | | | | |
|---|---|---|---|---|
| 2,004,715 | A | 6/1935 | Thwaits | |
| 2,320,567 | A | 6/1943 | Carlson | |
| 2,549,689 | A | 4/1951 | Jurs | |
| 2,652,070 | A | 9/1953 | Marx | |
| 3,809,115 | A | 5/1974 | Klein | |
| 4,310,012 | A | 1/1982 | Billington et al. | |
| 4,495,963 | A | 1/1985 | Hensley | |
| 5,694,965 | A * | 12/1997 | Roulet | G05D 16/10 137/102 |
| 8,678,050 | B2 | 3/2014 | Dobson et al. | |
| 2003/0102047 | A1* | 6/2003 | Lemmon | F17C 13/12 141/1 |
| 2009/0242071 | A1 | 10/2009 | Hamberg | |
| 2009/0277634 | A1* | 11/2009 | Case | E21B 21/062 166/275 |
| 2014/0254738 | A1 | 9/2014 | Kubota et al. | |

FOREIGN PATENT DOCUMENTS

| | | |
|---|---|---|
| EP | 1609508 | 6/2008 |
| GB | 508620 | 7/1939 |

* cited by examiner

*Primary Examiner* — Timothy L Maust
*Assistant Examiner* — Andrew Schmid
(74) *Attorney, Agent, or Firm* — Giuseppe Mariconda

(57) ABSTRACT

An apparatus is for a hazardous-fluid delivery vehicle configured to convey a hazardous fluid, and for a storage tank configured to receive the hazardous fluid. The apparatus includes a fluid-input section configured to fluidly connect with the hazardous-fluid delivery vehicle. A valve assembly is in fluid communication with the fluid-input section. A fluid-output section is configured to fluidly connect the valve assembly with the storage tank. A valve actuator is operatively coupled to the valve assembly. The valve actuator is configured to actuate the valve assembly between a valve-closed state and a valve-opened state for the case where the valve actuator receives an actuation signal from an operator that is situated at a predetermined safe distance from the valve assembly. The predetermined safe distance is located proximate to the control section of the hazardous-fluid delivery vehicle.

7 Claims, 3 Drawing Sheets

APPARATUS FOR HAZARDOUS-FLUID DELIVERY VEHICLE AND STORAGE TANK

TECHNICAL FIELD

Some aspects generally relate to (and are not limited to) an apparatus for a hazardous-fluid delivery vehicle configured to convey a hazardous fluid, and for a hazardous-fluid storage tank (and method thereof).

BACKGROUND

A hazardous fluid is received in (stored in) a storage tank and may be removed therefrom. A manually-operated valve is used to permit the flow of the hazardous fluid into and out of the storage tank.

SUMMARY

In the event that something may happen to a delivery hose that is connected to the manually-operated valve and the storage tank was filled with the hazardous fluid, no one would be able to manually close the manually-operated valve of the storage tank to stop the unwanted flow, thus causing personal injury or an environmental disaster that could cost millions of dollars.

It will be appreciated that there exists a need to mitigate (at least in part) at least one problem associated with existing hazardous-fluid delivery vehicles and hazardous-fluid storage tanks After much study of the known systems and methods with experimentation, an understanding of the problem and its solution has been identified and is articulated as follows:

To mitigate, at least in part, at least one problem associated with existing hazardous-fluid delivery vehicles and hazardous-fluid storage tanks, there is provided (in accordance with a major aspect) an apparatus. The apparatus is for a hazardous-fluid delivery vehicle configured to convey a hazardous fluid, and for a storage tank configured to receive the hazardous fluid. The apparatus includes a fluid input section configured to fluidly connect with the hazardous-fluid delivery vehicle. A valve assembly is in fluid communication with the fluid input section. A fluid output section is configured to fluidly connect the valve assembly with the storage tank. A valve actuator is operatively coupled to the valve assembly. The valve actuator is configured to actuate the valve assembly between a valve-closed state and a valve-opened state for the case where the valve actuator receives an actuation signal from (initiated by) an operator that is situated at a predetermined safe distance from the valve assembly. The predetermined safe distance is located proximate to a control section of the hazardous-fluid delivery vehicle.

To mitigate, at least in part, at least one problem associated with existing hazardous-fluid delivery vehicles and hazardous-fluid storage tanks, there is provided (in accordance with a major aspect) an apparatus. The apparatus is for a hazardous-fluid delivery vehicle configured to convey a hazardous fluid, and for a storage tank configured to receive the hazardous fluid. The apparatus includes a fluid input section configured to fluidly connect with the hazardous-fluid delivery vehicle. This is done in such a way that the fluid input section fluidly receives the hazardous fluid from the hazardous-fluid delivery vehicle once fluidly connected to do just so. A valve assembly is in fluid communication with the fluid input section. The valve assembly is configured to operate in a valve-closed state and a valve-opened state. In the valve-closed state, the valve assembly does not permit an in-flow of the hazardous fluid from the fluid input section. In the valve-opened state, the valve assembly permits the in-flow of the hazardous fluid from the fluid input section. A valve actuator is operatively coupled to the valve assembly. The valve actuator is configured to actuate the valve assembly between the valve-closed state and the valve-opened state for the case where the valve actuator receives an actuation signal from (initiated by) an operator that is situated at a predetermined safe distance from the valve assembly. The predetermined safe distance is located proximate to the controls of the hazardous-fluid delivery vehicle. A fluid output section is configured to fluidly connect the valve assembly with the storage tank. This is done in such a way that the fluid output section conveys the hazardous fluid from the valve assembly to the storage tank for a case where the fluid input section fluidly receives the hazardous fluid from the hazardous-fluid delivery vehicle, and the valve assembly is operated in the valve-opened state.

To mitigate, at least in part, at least one problem associated with existing hazardous-fluid delivery vehicles and hazardous-fluid storage tanks, there is provided (in accordance with a major aspect) a method. The method is for operating an apparatus for a hazardous-fluid delivery vehicle configured to convey a hazardous fluid, and for a storage tank configured to receive the hazardous fluid. The method includes the following operations: an operation (A), an operation (B), and an operation (C). The operation (A) includes fluid connecting (communicating) a valve assembly with the fluid input section. The fluid input section is configured to fluidly connect with the hazardous-fluid delivery vehicle (this is done in such a way that the fluid input section fluidly receives the hazardous fluid from the hazardous-fluid delivery vehicle once fluidly connected to do just so). The valve assembly is configured to operate in a valve-closed state and a valve-opened state. In the valve-closed state, the valve assembly does not permit an in-flow of the hazardous fluid from the fluid input section. In the valve-opened state, the valve assembly permits the in-flow of the hazardous fluid from the fluid input section. The operation (B) includes operatively coupling a valve actuator to the valve assembly. The valve actuator is configured to actuate the valve assembly between the valve-closed state and the valve-opened state for the case where the valve actuator receives an actuation signal from (initiated by) an operator that is situated at a predetermined safe distance from the valve assembly. The predetermined safe distance is located proximate to the control section of the hazardous-fluid delivery vehicle. The operation (C) includes fluidly connecting (communicating) a fluid output section with the valve assembly. The fluid output section is configured to fluidly connect with the storage tank (this is done in such a way that the fluid output section conveys the hazardous fluid from the valve assembly to the storage tank for a case where the fluid input section fluidly receives the hazardous fluid from the hazardous-fluid delivery vehicle, and the valve assembly is operated in the valve-opened state).

Other aspects are identified in the claims.

Other aspects and features of the non-limiting embodiments may now become apparent to those skilled in the art upon review of the following detailed description of the non-limiting embodiments with the accompanying drawings.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
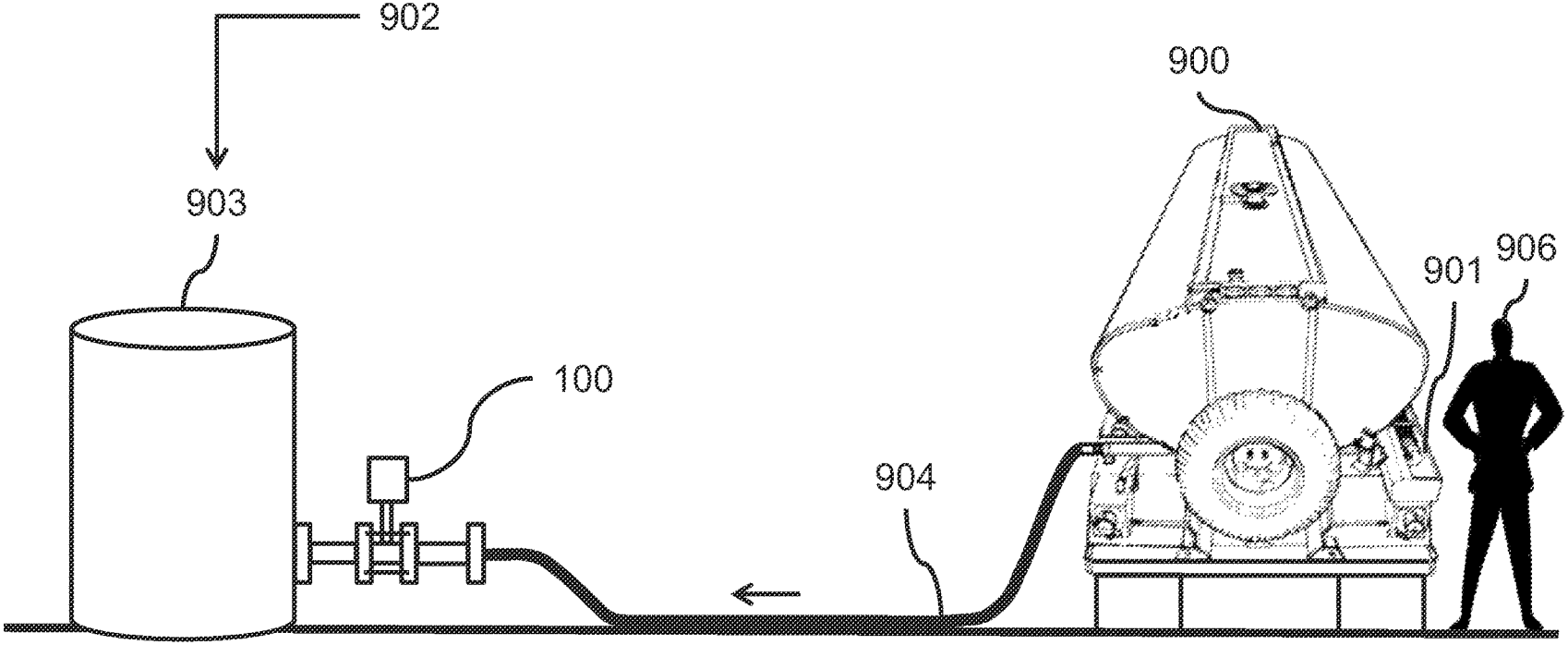
FIG. 1 depicts a schematic representation of an embodiment of an apparatus for a hazardous-fluid delivery vehicle and a storage tank.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted.

Corresponding reference characters indicate corresponding components throughout the several figures of the Drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

100 apparatus
102 fluid-input section
104 valve assembly
106 valve actuator
108 fluid-output section
900 hazardous-fluid delivery vehicle
901 control section
902 storage tank
903 stationary hazardous-fluid storage tank
904 delivery line
905 frac pumper
906 operator
908 pneumatic compressor
910 air-line

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the invention is defined by the claims. For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described.

FIG. 1 depicts a schematic representation of an embodiment of an apparatus 100 for a hazardous-fluid delivery vehicle 900 and a storage tank 902.

The apparatus 100 is for a hazardous-fluid delivery vehicle 900 configured to convey a hazardous fluid, and is also for a storage tank 902 configured to receive the hazardous fluid.

By way of an embodiment, the hazardous-fluid delivery vehicle 900 includes a low-pressure truck. The storage tank 902 may include a cylindrical stationary storage tank. The storage tank 902 is configured to receive and to store the hazardous fluid. By way of another embodiment, the storage tank 902 includes a stationary hazardous-fluid storage tank 903. The hazardous-fluid delivery vehicle 900 is configured to pump the hazardous fluid under a low pressure to a low-pressure side (suction) of the storage tank 902 (which is classified as a high-pressure unit). The operator 906 (also called a worker) hooks up the apparatus 100 to the hazardous-fluid delivery vehicle 900 and to the storage tank 902. By way of embodiment, the hazardous fluid may include an acid (such as, hydrochloric acid), a flammable material, etc. In accordance with an embodiment, the hazardous fluid includes hydrochloric acid.

Figure 2:
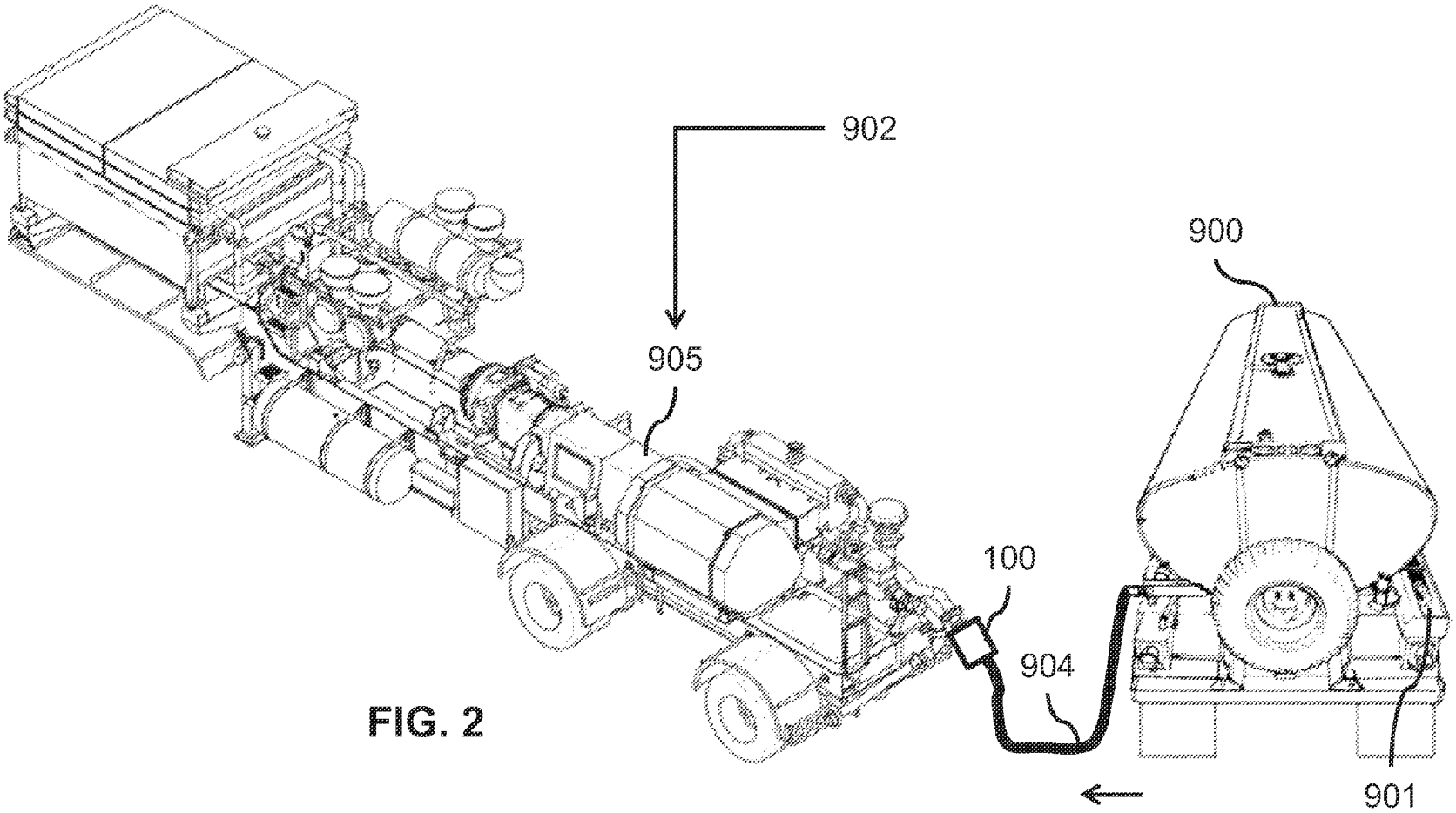
FIG. 2 depicts another schematic representation of an embodiment of the apparatus of FIG. 1.

FIG. 2 depicts a schematic representation of another embodiment of the apparatus 100 of FIG. 1.

In accordance with the embodiment depicted in FIG. 2, the storage tank 902 includes a frac pumper 905. The frac pumper 905 is deployed (used) in the gas and oil industry. The frac pumper 905 is configured to convey a fracing fluid on site. From time to time, the frac pumper 905 is to receive hydrochloric acid (or any type of hazardous fluid) for the purposes of cleaning out the storage cavity of the frac pumper 905, etc.

Figure 3:
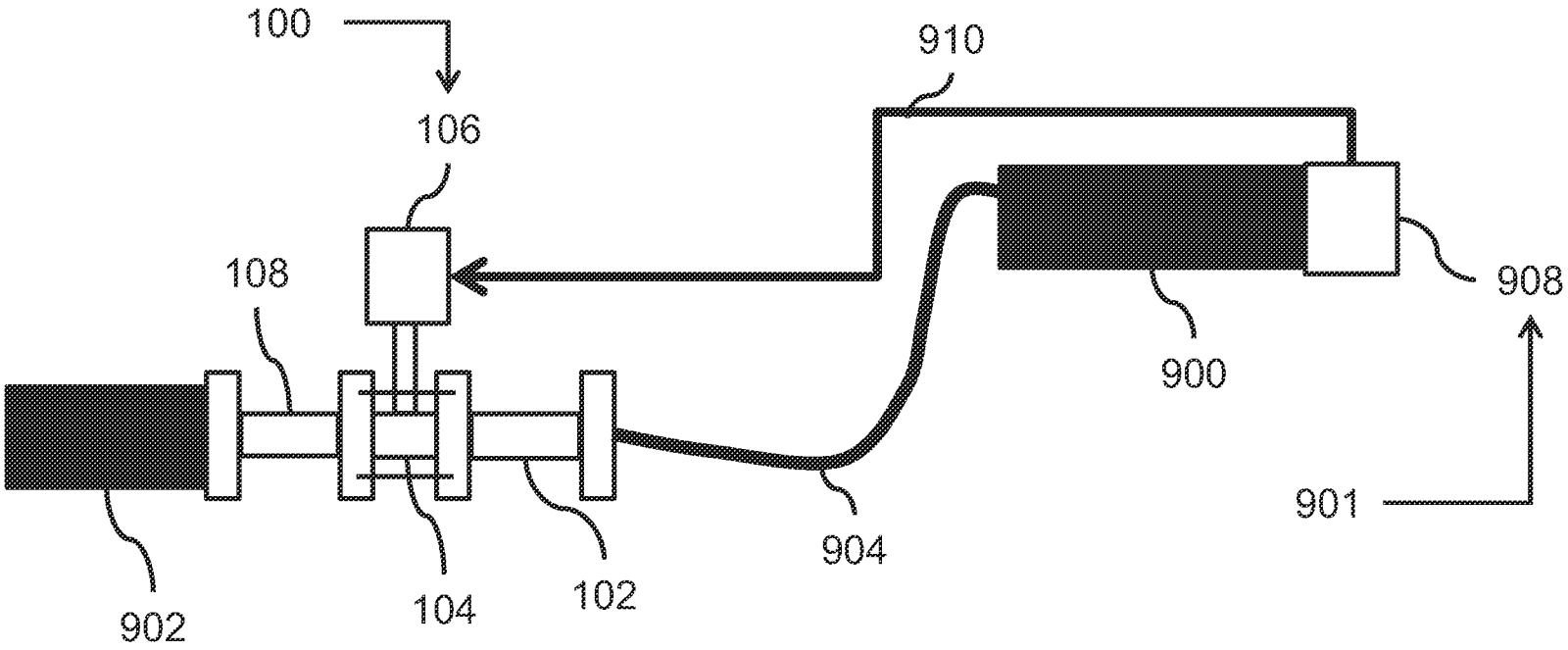
FIG. 3 depicts yet another schematic representation of an embodiment of the apparatus of FIG. 1.

FIG. 3 depicts a schematic representation of yet another embodiment of the apparatus 100 of FIG. 1.

It will be appreciated that the embodiment of the apparatus 100 (depicted in FIG. 3) may be used in the embodiments depicted in FIGS. 1 and 2. The apparatus 100 includes a combination of a fluid-input section 102, a valve assembly 104, a valve actuator 106, and a fluid-output section 108. The fluid-input section 102 is configured to fluidly connect (directly or indirectly) with the hazardous-fluid delivery vehicle 900. By way of an embodiment, the fluid-input section 102 is configured to be operatively fluidly connected to a delivery line 904. The delivery line 904 is configured to fluidly convey the hazardous fluid from the hazardous-fluid delivery vehicle 900 to the fluid-input section 102. The valve assembly 104 is in fluid communication (directly or indirectly) with the fluid-input section 102. The fluid-output section 108 is configured to fluidly connect (directly or indirectly) the valve assembly 104 with the storage tank 902. The valve actuator 106 is operatively coupled (directly or indirectly) to the valve assembly 104. The valve actuator 106 is configured to actuate the valve assembly 104 between a valve-closed state and a valve-opened state for the case where the valve actuator 106 receives an actuation signal from (initiated by) an operator 906, in which the operator 906 is situated at a predetermined safe distance from the valve assembly 104. The predetermined safe distance is located proximate to the control section 901 of the hazardous-fluid delivery vehicle 900 (as depicted in FIG. 1).

By way of an embodiment, the valve assembly 104 and the valve actuator 106 is provided by the NORRISEAL (TRADEMARK) valve assembly Model Number R131122BBBASTU0073/4-100 manufactured by Alberta Oil Tool Company based on Alberta, Canada (A Dover Company, and may be reached via telephone at 1 (780) 434-8556), along with other associated connection hardware. The combination of the valve assembly 104 and the valve actuator 106 was adapted in such a way that the valve assembly 104 defaults to a closed position.

In accordance with a more specific embodiment, the apparatus 100 is adapted so that the fluid-input section 102 is configured to fluidly connect (directly or indirectly) with the hazardous-fluid delivery vehicle 900. This is done in such a way that the fluid-input section 102 fluidly receives the hazardous fluid from the hazardous-fluid delivery vehicle 900 once fluidly connected to do just so. The valve assembly 104 is in fluid communication (directly or indirectly) with the fluid-input section 102. The valve assembly 104 is configured to operate in a valve-closed state and a valve-opened state. In the valve-closed state, the valve assembly 104 does not permit an in-flow of the hazardous fluid from the fluid-input section 102. In the valve-opened state, the valve assembly 104 permits the in-flow of the hazardous fluid from the fluid-input section 102. The valve actuator 106 is operatively coupled to the valve assembly 104. The valve actuator 106 is configured to actuate the valve assembly 104 between the valve-closed state and the valve-opened state in response to receiving an actuation signal from (initiated by) an operator 906 (depicted in FIG. 1) situated at a predetermined safe distance from the valve assembly 104. The predetermined safe distance is located proximate to the control section 901 of the hazardous-fluid delivery vehicle 900 (as depicted in FIG. 1). The fluid-output section 108 is configured to fluidly connect (directly or indirectly) the valve assembly 104 with the storage tank 902. This is done in such a way that the fluid-output section 108 conveys the hazardous fluid from the valve assembly 104 to the storage tank 902 for the case where the fluid-input section 102 fluidly receives the hazardous fluid from the hazardous-fluid delivery vehicle 900, and the valve assembly 104 is operated in the valve-opened state.

It will be appreciated that in view of the foregoing, a method is provided for operating the apparatus 100. The method includes an operation (A), an operation (B), and an operation (C). The operation (A) includes fluid connecting (communicating) the valve assembly 104 with the fluid-input section 102. The fluid-input section 102 is configured to fluidly connect (directly or indirectly) with the hazardous-fluid delivery vehicle 900. This is done in such a way that the fluid-input section 102 fluidly receives the hazardous fluid from the hazardous-fluid delivery vehicle 900 once fluidly connected to do just so. The valve assembly 104 is configured to operate in a valve-closed state and a valve-opened state. In the valve-closed state, the valve assembly 104 does not permit an in-flow of the hazardous fluid from the fluid-input section 102. In the valve-opened state, the valve assembly 104 permits the in-flow of the hazardous fluid from the fluid-input section 102.

The operation (B) includes operatively coupling the valve actuator 106 to the valve assembly 104. The valve actuator 106 is configured to actuate the valve assembly 104 between the valve-closed state and the valve-opened state in response to receiving an actuation signal from (initiated by) the operator 906 (depicted in FIG. 1) that is situated at a predetermined safe distance from the valve assembly 104. The predetermined safe distance is located proximate to the control section 901 of the hazardous-fluid delivery vehicle 900 (as depicted in FIG. 1).

The operation (C) includes fluidly connecting or communicating (directly or indirectly) a fluid-output section 108 with the valve assembly 104. The fluid-output section 108 is configured to fluidly connect (directly or indirectly) with the storage tank 902. This is done in such a way that the fluid-output section 108 conveys the hazardous fluid from the valve assembly 104 to the storage tank 902 for a case where the fluid-input section 102 fluidly receives the hazardous fluid from the hazardous-fluid delivery vehicle 900, and the valve assembly 104 is operated in the valve-opened state.

There are several advantages for the apparatus 100. For instance, the apparatus 100 provides a safer way to deliver the hazardous fluid (such as a corrosive acid) from the hazardous-fluid delivery vehicle 900 to the storage tank 902. The apparatus 100 provides a safer way to deliver the hazardous fluid (such as a corrosive acid) from the hazardous-fluid delivery vehicle 900 to the storage tank 902 in such a way that there is a lower possibility of an inadvertent environmental spill of the hazardous fluid and/or personal injury to workers. For the case where there is an unwanted environmental spill, the apparatus 100 may be actuated (remotely) to shut off the flow of the hazardous fluid from the hazardous-fluid delivery vehicle 900 to the storage tank 902. Of course, any remaining amount of the hazardous fluid in the connection lines may be sucked back into the hazardous-fluid delivery vehicle 900. Any possible spill then may be limited to the amount of hazardous fluid contained in the delivery hose (the delivery line 904). A possible spill that may occur with the apparatus 100 may be the amount of hazardous fluid remaining in a delivery hose, which is minimal compared to the amount of hazardous fluid contained in the storage tank 902. For instance, the delivery line 904 (depicted in FIG. 1) may hold up to about 100 liters (if so desired), and the storage tank 902 can hold up to about 60,000 liters of the hazardous fluid, when full (if so desired).

In accordance with an embodiment, the valve actuator 106 is configured to be pneumatically operated by a pneumatic compressor 908 (air compressor) having an air-line 910 configured to fluidly connect with the valve actuator 106. The pneumatic compressor 908 may be a part of the control section 901 (of the hazardous-fluid delivery vehicle 900).

In accordance with an embodiment, the valve actuator 106 is configured to be electrically operated.

In accordance with an embodiment, the valve actuator 106 is configured to operate under pneumatic pressure (air pressure). This is done in such a way that: (A) for the case where pneumatic pressure is applied to the valve actuator 106, the valve assembly 104 operates in the valve-opened state (under remote control operation), and (B) for the case where pneumatic pressure is not applied to the valve actuator 106, the valve assembly 104 operates in the valve-closed state (under remote control operation).

For the case where there is a leak or disconnection at the valve assembly 104, the operator 906 may remotely (safely) close the valve assembly 104 in such a way that the operator (the operator 906 of FIG. 1) gets covered (at least in part) with the hydrochloric acid, and thereby averting an unwanted flow (spillage) from the storage tank 902 (by safely shutting flow off while the operator 906 stands at a position located remotely from the valve assembly 104, as depicted in FIG. 1). By way of an embodiment, the storage tank 902 may include a 400-barrel tank. For the case where the air supply line is disrupted (in any way), blocked, restricted or taken off, the valve assembly 104 is configured to safely default to a closed position, thus not causing the contents of the storage tank 902 (having the hydrochloric acid) to spill therefrom and to harm the environment. The operator 906 (depicted in FIG. 1) operatively connects the valve actuator 106 (such as, to an air hose for providing air to actuate the valve actuator 106 and thereby open the valve assembly 104, and for closing the valve assembly 104, all performed remotely from the valve assembly 104, such as from the controls positioned at the hazardous-fluid delivery vehicle 900). In accordance with a preferred option, the valve assembly 104 is configured to default to a valve-closed state in the event that the air supply line becomes disconnected or damaged (or if the valve actuator 106 becomes inoperative for any reason whatsoever).

In accordance with an embodiment, the valve actuator 106 is configured to actuate the valve assembly 104 from the valve-opened state (position) to the valve-closed state in response to the case where there is loss of pressure in the hazardous fluid flowing through the valve assembly 104.

For the case where the delivery line 904 has a leak or comes disconnected, the valve actuator 106 includes a spring configured to urge the valve assembly 104 to the valve-closed position (a default position) in the event the delivery line 904 has a leak or becomes disconnected from the valve assembly 104.

In accordance with an embodiment, the valve actuator 106 is configured to operate under electrical control. It will be appreciated that an electrically controlled instance of the valve actuator 106 may be relatively expensive.

It will be appreciated that for using the apparatus 100 in connection with hauling and/or transferring fuel or methanol (flammable liquid or any type of hazardous-fluid) into a storage container, the electrically controlled instance of the valve actuator 106 may not be used since the electrically controlled instance of the valve actuator 106 may be susceptible to inadvertent sparking (leading to an unwanted explosion for the case where a flammable liquid is to be managed by the apparatus 100).

In accordance with a preferred embodiment, the air provided by the air brakes of the hazardous-fluid delivery vehicle 900 may be used to drive the valve actuator 106 (if so desired). Specifically, the hazardous-fluid delivery vehicle 900 may include air brakes that are configured to drive or operate the valve actuator 106, thereby driving or operating the valve assembly 104 to open or close accordingly, as may be required. In summary, the hazardous-fluid delivery vehicle 900 includes air brakes, and the valve actuator 106 is configured to be operated by the air brakes of the hazardous-fluid delivery vehicle 900.

This written description uses examples (embodiments) to disclose the invention, including the best mode, and also to enable any person skilled in the art to make and use the invention. The patentable scope of the invention is defined by the claims, and may include other examples that occur to those skilled in the art. Such other examples are within the scope of the claims if they have structural elements that do not differ from the literal language of the claims, or if they include equivalent structural elements with insubstantial differences from the literal language of the claims.

It may be appreciated that the assemblies and modules described above may be connected with each other as required to perform desired functions and tasks within the scope of persons of skill in the art to make such combinations and permutations without having to describe each and every one in explicit terms. There is no particular assembly or component that may be superior to any of the equivalents available to the person skilled in art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) the description provided outside of this document (that is, outside of the instant application as filed, as prosecuted, and/or as granted). It is understood, for this document, that the phrase "includes" is equivalent to the word "comprising." The foregoing has outlined the non-limiting embodiments (examples). The description is made for particular non-limiting embodiments (examples). It is understood that the non-limiting embodiments are merely illustrative as examples.

What is claimed is:

1. An apparatus comprising:

a movable hazardous-fluid delivery vehicle; and a first storage tank mounted to the movable hazardous-fluid delivery vehicle in such a way that the first storage tank is movable by the movable hazardous-fluid delivery vehicle, and the first storage tank configured to receive a hazardous fluid; and a hazardous-fluid delivery line configured to fluidly connect with the first storage tank; and the movable hazardous-fluid delivery vehicle configured to be movable relative to a second storage tank, in which the second storage tank is configured to fluidly connect with the hazardous-fluid delivery line in such a way that the hazardous-fluid delivery line, in use, conveys the hazardous fluid from the first storage tank of the movable hazardous-fluid delivery vehicle to the second storage tank; and a fluid-input section being configured to fluidly connect to the hazardous-fluid delivery line, with the hazardous-fluid delivery line configured to be fluidly connected to the first storage tank of the movable hazardous-fluid delivery vehicle in such a way that the fluid-input section fluidly receives the hazardous fluid from the first storage tank of the movable hazardous-fluid delivery vehicle once fluidly connected; and a valve assembly being in fluid communication with the fluid-input section, and the valve assembly being configured to operate in a valve-closed state, in which the valve assembly does not permit an in-flow of the hazardous fluid from the fluid-input section, and a valve-opened state, in which the valve assembly permits the in-flow of the hazardous fluid from the fluid-input section; and a fluid-output section being configured to fluidly connect the valve assembly with the second storage tank in such a way that the fluid-output section conveys the hazardous fluid from the valve assembly to the second storage tank, in which the fluid-input section, in use, fluidly receives the hazardous fluid from the first storage tank of the movable hazardous-fluid delivery vehicle, and the valve assembly is operated in the valve-opened state; and a control section mounted to the movable hazardous-fluid delivery vehicle; and a valve actuator being configured to be selectively controlled by the control section; and the valve actuator being operatively coupled to the valve assembly, and the valve actuator being configured to selectively actuate the valve assembly between the valve-closed state and the valve-opened state in response to the valve actuator being actuatable by an operator being situated at a predetermined safe distance from the valve assembly, and the predetermined safe distance being located proximate to the control section of the movable hazardous-fluid delivery vehicle; and wherein in the valve-opened state, the valve actuator, in use, selectively urges the valve assembly to open and permit the hazardous fluid to flow, along the hazardous-fluid delivery line, from the first storage tank of the movable hazardous-fluid delivery vehicle and into the second storage tank once the first storage tank of the movable hazardous-fluid delivery vehicle, the hazardous-fluid delivery line and the second storage tank are in fluid communication with each other; and wherein the valve actuator is configured to be pneumatically operated by a pneumatic compressor having an air-line configured to fluidly connect with the valve actuator; and wherein the pneumatic compressor is a part of the control section of the movable hazardous-fluid delivery vehicle.

2. The apparatus of claim 1, wherein:

the valve actuator is configured to operate under pneumatic pressure in such a way that:

for the case where pneumatic pressure is applied to the valve actuator, the valve assembly operates in the valve-opened state; and for the case where pneumatic pressure is not applied to the valve actuator, the valve assembly operates in the valve-closed state.

3. The apparatus of claim 1, wherein:

the valve actuator is configured to operate under electrical control.

4. The apparatus of claim 1, wherein:

the hazardous fluid includes hydrochloric acid.

5. The apparatus of claim 1, wherein:

the valve actuator is configured to be electrically operated.

6. The apparatus of claim 1, wherein:

the movable hazardous-fluid delivery vehicle includes air brakes; and the valve actuator is configured to be operated by air provided by the air brakes of the movable hazardous-fluid delivery vehicle.

7. A method for operating a movable hazardous-fluid delivery vehicle having a first storage tank, in which the first storage tank is mounted to the movable hazardous-fluid delivery vehicle in such a way that the first storage tank is movable by the movable hazardous-fluid delivery vehicle, and in which the first storage tank is configured to receive a hazardous fluid, and in which the movable hazardous-fluid delivery vehicle is configured to be movable relative to a second storage tank, the method comprising:

fluidly connecting a hazardous-fluid delivery line with the first storage tank of the movable hazardous-fluid delivery vehicle; and fluidly connecting the second storage tank with the hazardous-fluid delivery line in such a way that the hazardous-fluid delivery line, in use, conveys the hazardous fluid from the first storage tank of the movable hazardous-fluid delivery vehicle to the second storage tank; and fluidly connecting a fluid-input section with the hazardous-fluid delivery line, with the hazardous-fluid delivery line configured to be fluidly connected to the first storage tank of the movable hazardous-fluid delivery vehicle in such a way that the fluid-input section fluidly receives the hazardous fluid from the first storage tank of the movable hazardous-fluid delivery vehicle once fluidly connected; and fluidly connecting a valve assembly with the fluid-input section, and the valve assembly configured to operate in a valve-closed state, in which the valve assembly does not permit an in-flow of the hazardous fluid from the fluid-input section, and a valve-opened state, in which the valve assembly permits the in-flow of the hazardous fluid from the fluid-input section; and using a fluid-output section to fluidly connect the valve assembly with the second storage tank in such a way that the fluid-output section conveys the hazardous fluid from the valve assembly to the second storage tank, in which the fluid-input section, in use, fluidly receives the hazardous fluid from the first storage tank of the movable hazardous-fluid delivery vehicle, and the valve assembly is operated in the valve-opened state; and selectively controlling a valve actuator with a control section mounted to the movable hazardous-fluid delivery vehicle, in which the valve actuator is operatively coupled to the valve assembly; and using the valve actuator to selectively actuate the valve assembly between the valve-closed state and the valve-opened state in response to the valve actuator being actuatable by an operator being situated at a predetermined safe distance from the valve assembly, and the predetermined safe distance being located proximate to the control section of the movable hazardous-fluid delivery vehicle; and using the valve actuator in the valve-opened state to selectively urge the valve assembly to open and permit the hazardous fluid to flow, along the hazardous-fluid delivery line, from the first storage tank of the movable hazardous-fluid delivery vehicle and into the second storage tank once the first storage tank of the movable hazardous-fluid delivery vehicle, the hazardous-fluid delivery line and the second storage tank are in fluid communication with each other; and pneumatically operating the valve actuator by a pneumatic compressor having an air-line configured to fluidly connect with the valve actuator, in which the pneumatic compressor is a part of the control section of the movable hazardous-fluid delivery vehicle.

* * * * *